US008272155B2

(12) United States Patent
Wang

(10) Patent No.: US 8,272,155 B2
(45) Date of Patent: Sep. 25, 2012

(54) AUTOMATIC BANNER ROLL-UP MECHANISM

(76) Inventor: Chao-Pang Wang, Taipei (TW)

( * ) Notice: Subject to any disclaimer, the term of this patent is extended or adjusted under 35 U.S.C. 154(b) by 330 days.

(21) Appl. No.: 12/815,385

(22) Filed: Jun. 14, 2010

(65) Prior Publication Data

US 2011/0303781 A1 Dec. 15, 2011

(51) Int. Cl.
*G09F 11/18* (2006.01)

(52) U.S. Cl. ..... 40/514; 40/517; 40/518; 40/520; 40/522; 242/375; 242/376

(58) Field of Classification Search ..... 40/514, 40/517, 518, 520, 522; 242/375, 376, 376.1, 242/598.3

See application file for complete search history.

(56) References Cited

U.S. PATENT DOCUMENTS 3,151,551 A * 10/1964 Dutro et al. ..... 101/216
3,448,943 A * 6/1969 Herou ..... 242/375
3,537,666 A * 11/1970 Lewis ..... 242/375
3,598,050 A * 8/1971 Thompson ..... 101/216
4,454,974 A * 6/1984 Cooke ..... 225/106
5,984,223 A * 11/1999 Hiramatsu ..... 242/379.1
5,996,923 A * 12/1999 Junquera ..... 242/375.3
6,402,085 B1 * 6/2002 Smith ..... 242/578
8,203,658 B2 * 6/2012 Wang ..... 348/841

* cited by examiner

*Primary Examiner* — Tashiana Adams
*Assistant Examiner* — Shin Kim

(57) ABSTRACT

The present invention provides an automatic banner roll-up mechanism for automatically rolling up a banner or poster, which includes two tubes, a foldable material cloth, a connecting rod, two plugs, a cylindrical spring, a stopper and two mounting supports. One end of the connecting rod is sheathed by one plug and the cylindrical spring, and it is retained in one of the mounting supports. Ball bearings in one of the plugs are engaged with the connecting rod when the plug is rotated to twist cylindrical spring tight. After rotating the plug in a reverse direction to release the cylindrical spring, the connecting rod rotates in the reverse direction, thereby rolling up the foldable material. Further, the foldable material may be coated or printed with various patterns for decorative or sun-shading purposes.

7 Claims, 7 Drawing Sheets

AUTOMATIC BANNER ROLL-UP MECHANISM

BACKGROUND OF THE INVENTION

1. Field of the Invention

The present invention relates to an automatic banner roll-up mechanism, and in particular to a mechanism for automatically rolling up a flag, banner or poster, in which a tube may be locked at a predetermined position or rotated to roll up the banner. Furthermore, a cloth wound around the tube is coated or printed with various patterns for decoration or providing a sun-shade. In this manner the convenience and aesthetic aspects of the entire structure are improved.

2. Description of the Prior Art

Sales can be promoted by advertisements or other promotional products. Advertisements are shown on TV, radio broadcasts, newspapers, magazines, posters, the Internet or fliers. Promotional products include post cards, bookmarkers, pens, desk calendars, water bottles, color pins and the like. Both advertisements and promotional products are important for improving sales.

Usually, a banner or poster is displayed in a public place by hanging it from a pole or placing it on a wall with, for example, magnets or thumbtacks. Placing various banners or posters in a public place may make it look untidy. On the other hand, the thumbtacks or magnets used for placing the banners or posters may become wet from external moisture, may blow off or even suffer damage due to vandalism. As a result, the advertising effectiveness of the banners or posters may become greatly deteriorated.

SUMMARY OF THE INVENTION

In view of the above, the present Inventor proposes an automatic banner roll-up mechanism based on his expert knowledge in this field, in which a connecting rod, two plugs, a cylindrical spring and a stopper are provided in a tube. One of the plugs has a portion engaged with the cylindrical spring to lock the tube into a predetermined position, or the tube can roll up for compact storage of the banner. A cloth wound around the tube is coated or printed with various patterns for decoration or sun-shading effects, thereby increasing the aesthetics of the ambient environment.

According to an automatic banner roll-up mechanism of an embodiment of the present invention, the plug is provided with a threaded portion.

According to an automatic banner roll-up mechanism of an embodiment of the present invention, the interior of the plug is provided with a plurality of troughs.

According to an automatic banner roll-up mechanism of an embodiment of the present invention, the interior of the plug is provided with a plurality of ball bearings.

According to an automatic banner roll-up mechanism of an embodiment of the present invention, the connecting rod has a first retaining portion, a second retaining portion, and a third retaining portion.

According to an automatic banner roll-up mechanism of an embodiment of the present invention, the first retaining portion has two troughs.

According to an automatic banner roll-up mechanism of an embodiment of the present invention, the third retaining portion has an annular slot.

The detailed description and technical contents of the present invention will be explained with reference to the accompanying drawings.

DETAILED DESCRIPTION OF THE INVENTION

Figure 1:
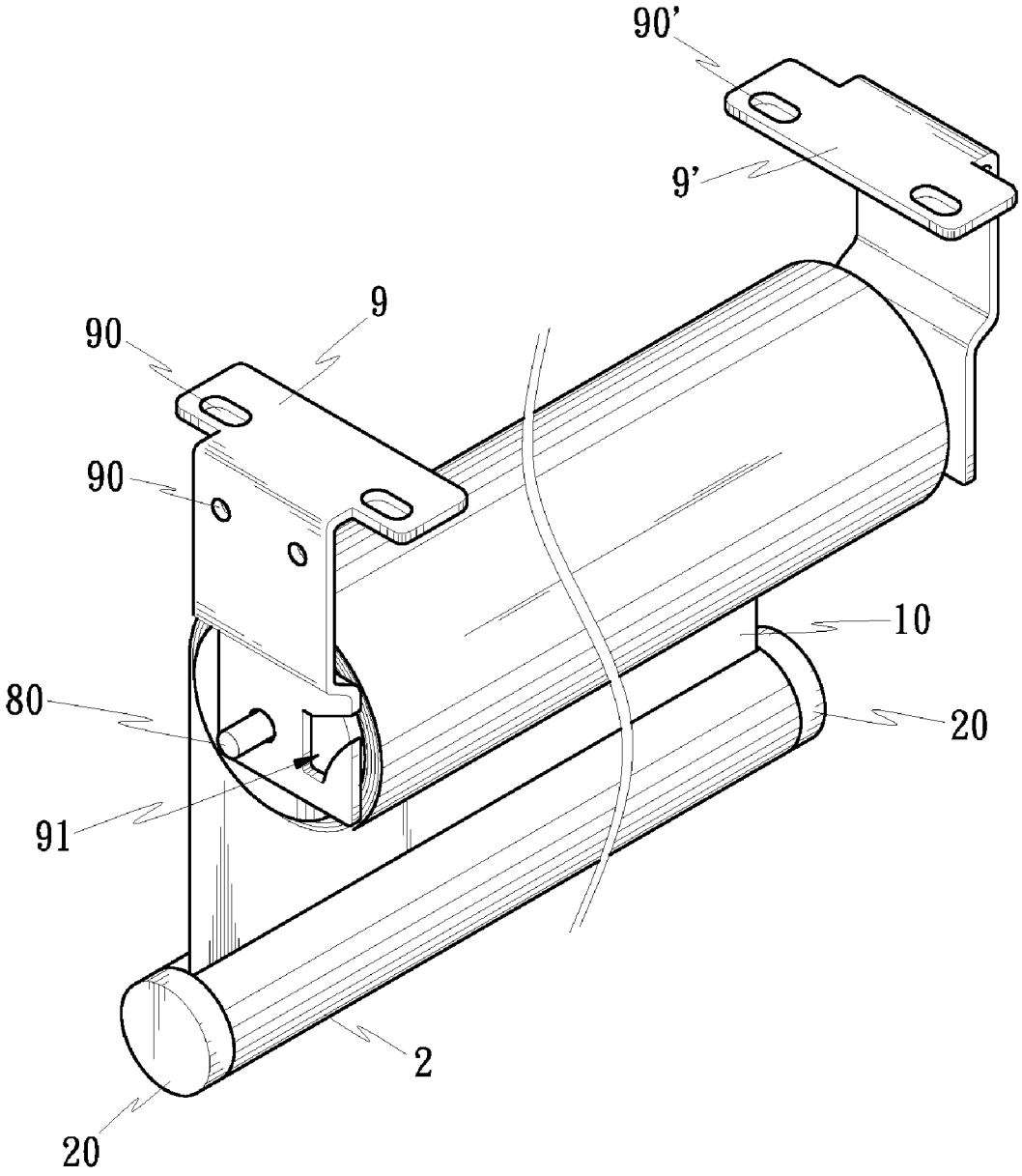
FIG. 1 is a perspective view showing an embodiment automatic banner roll-up mechanism of the present invention.
Figure 2:
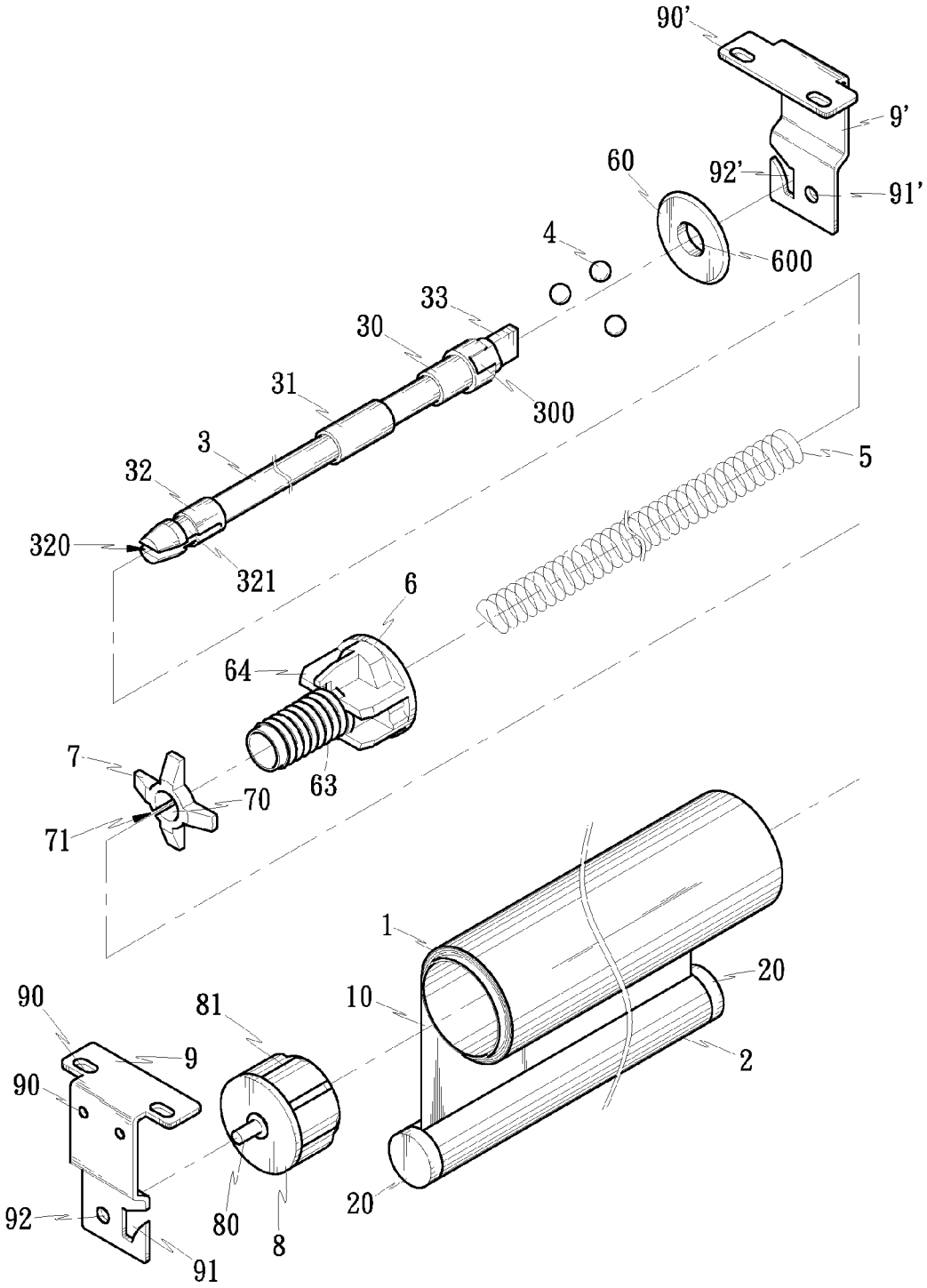
FIG. 2 is an exploded perspective view showing an embodiment automatic banner roll-up mechanism of the present invention.

First, please refer to FIGS. 1 and 2. The present invention is directed to an automatic banner roll-up mechanism, and an e/mbodiment thereof includes a first tube 1, a cloth 10, a second tube 2, a connecting rod 3, a plurality of ball bearings 4, a cylindrical spring 5, plugs 6 and 8, a stopper 7 and two mounting supports 9, 9'. The cloth 10 is connected between the first tube 1 and the second tube 2. The plug 8 covers one open end of the firs tube 1 and the plug 6 is disposed in the other open end of the first tube 1. The connecting rod 3 penetrates the plug 6. The cylindrical spring 5 and the stopper 7 are sheathed on the connecting rod 3. Further, the ball bearings 4 are disposed in the plug 6. The first tube 1 is disposed between the mounting supports 9 and 9'. With the engagement of the ball bearings 4 with the connecting rod 3 and the elastic force of the cylindrical spring 5, the cloth 10 wound around the first tube 1 can be rolled up automatically.

The periphery of the plug 8 disposed in one end of the first tube 1 is provided with a plurality of ribs 81. The diameter of a circle formed by the outer surfaces of the ribs 81 is substantially equal to the inner diameter of the first tube 1. The center of the plug 8 on its one side is provided with a positioning post 80 inserted into a positioning hole 92 of the mounting support 9. The plug 6 is disposed in the other end of the first tube 1. The connecting rod 3, the ball bearings 4, the cylindrical spring 5 and the stopper 7 are disposed in the first tube 1. The plug 6 is formed into a hollow cylinder with a T-shaped cross section. The periphery of the plug 6 is formed with a plurality of ridges 64. The largest diameter of a circle formed by the ridges 64 is substantially equal to the inner diameter of the first tube 1. One side of the plug 6 is formed into a threaded post 63 onto which the cylindrical spring 5 is sheathed. The center of the plug 6 has a through-hole for allowing the connecting rod 3 to pass through. The ball bearings 4 are disposed within the interior of the plug 6. A cover 60 covers one side of the plug 6, thereby preventing the plug 6 from sliding out and the ball bearings 4 from falling out. The connecting rod 3 is in the form of an elongate cylindrical rod.

The front, middle and rear sections of the connecting rod 3 are provided by a first retaining portion 30, a second retaining portion 31 and a third retaining portion 32, respectively. The periphery of the first retaining portion 30 includes a plurality of notches 300. One side surface of the first retaining portion 30 includes a positioning post 33 that can be inserted into a positioning hole 92' of the mounting support 9'. The center of the third retaining portion 32 includes a groove 320. The middle section of the third retaining portion 32 has an annular slot 321. One end of the cylindrical spring 5 is engaged in the groove 320, and the stopper 7 is engaged in the annular slot 321. The diameter of the outer periphery of the first retaining portion 30 or the second retaining portion 31 is substantially equal to the diameter of the through-hole in the center of the plug 6. The stopper 7 is shaped as a cross and has a through-hole 70 in its center. The edge of the stopper 7 has a groove 71, whereby the through-hole 70 can have a little space for elastic deformation. The third retaining portion 32 of the connecting rod 3 penetrates the through-hole 70 in such a manner that the stopper 7 is retained by the annular slot 321. The mounting supports 9 and 9' are each in the form of an L-shaped plate. A horizontal surface and a vertical surface of the mounting supports 9, 9' are provided with a plurality of through-holes 90, 90' respectively. One end of the vertical surface has a circular positioning hole 91, 91', and a vertical surface thereof is provide with a rectangular positioning hole 92, 92'. The positioning post 80 of the plug 8 is inserted into the positioning holes 92, and the positioning post 33 of the connecting rod 3 is inserted into the positioning hole 92'.

The connecting rod 3 penetrates the plug 6. The cylindrical spring 5 is sheathed on the plug 6. The ball bearings 4 are disposed in the plug 6, and the stopper 7 is sheathed on the connecting rod 3. Then, the above assembly is disposed in the first tube 1. Both ends of the first tube 1 are covered by the plugs 8 and 6 respectively. Then, the positioning post 80 of the plug 8 is inserted into the positioning hole 92 of the mounting support 9. The positioning post 33 penetrating the plug 6 is inserted into the positioning hole 92' of the mounting support 9'. In this way, the first tube 1 can be fixedly supported on the mounting supports 9, 9'. Since the cylindrical spring 5 urges the plug 6, the notches 300 of the first retaining portion 30 of the connecting rod 3 are engaged with the ball bearings 4. When the ball bearings 4 are separated from the notches 300, the cylindrical spring 5 becomes slack, so that the connecting rod 3 can rotate to drive the first tube 1 to rotate in a reverse direction to roll up the cloth 10. One end of the cloth 10 is connected to the second tube 2 and the other end thereof is connected into the first tube 1. The cloth 1 is coated or printed with various patterns or an anti-UV layer for decoration or sun-shading purposes.

Figure 3A:
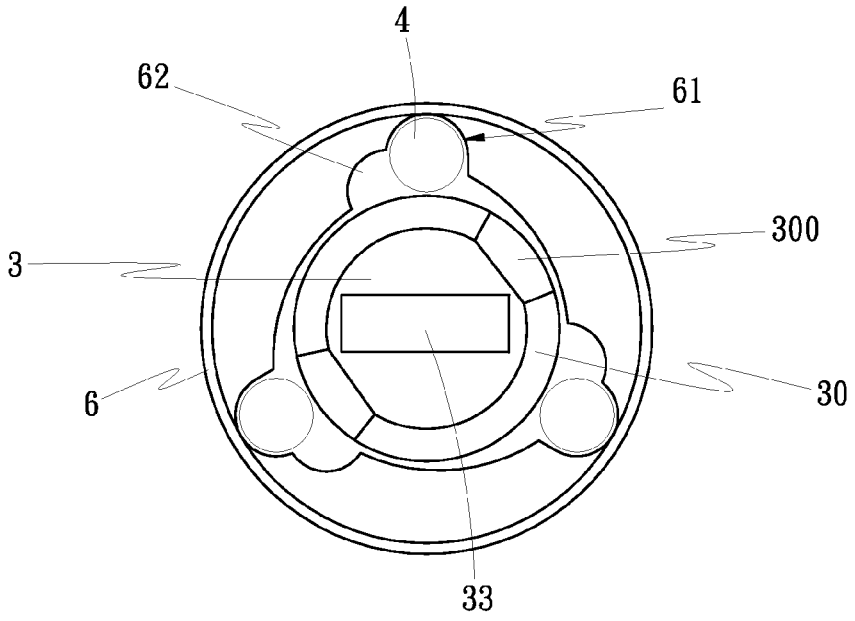
FIG. 3*a* is a schematic view showing ball bearings that are received in a plug according to an embodiment of the present invention.
Figure 3B:
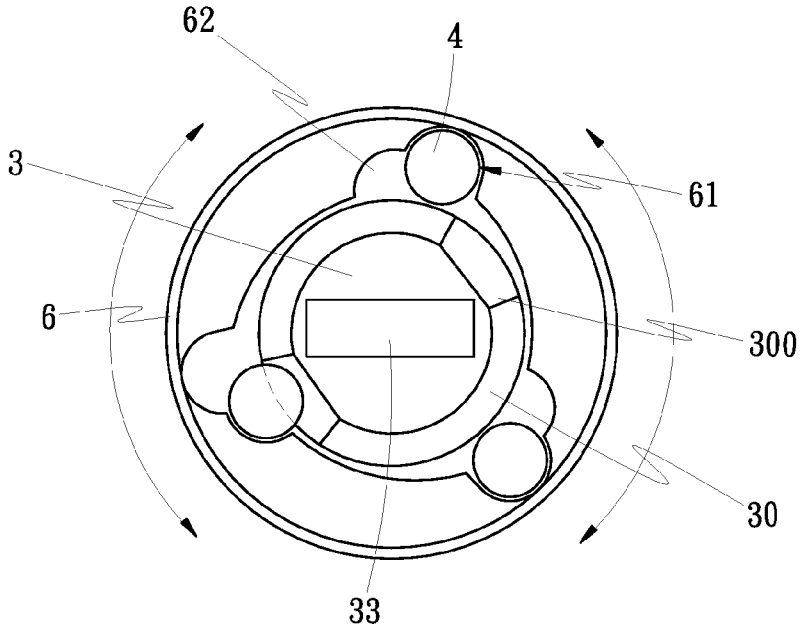
FIG. 3*b* is a schematic view showing ball bearings engaged in a plug according to an embodiment of the present invention.

Please also refer to FIGS. 3*a* and 3*b*, which show that the ball bearings 4 are engaged in the plug 6. The plug 6 is a cylindrical post having a through-hole formed in its axial center. The interior of the plug 6 is formed with a plurality of first troughs 61 and second troughs 62. One of the first troughs 61 is provided adjacent to one of the second troughs 62 to thereby form three groups separated by 120 degrees. The ball bearings 4 are disposed in the first troughs 61 respectively. The maximum diameter of a circle formed by the ball bearings 4 is substantially equal to the outer diameter of the first retaining portion 30. When the plug 6 rotates in one direction, the ball bearings 4 are driven to move into the second troughs 62 and engaged with the notches 300 of the first retaining portion 30 of the connecting rod 3 respectively, so that the plug 6 is prevented from further rotation. At this time, the cylindrical spring 5 sheathed on the plug 6 is twisted tight due to the positive rotation of the plug 6. After rotating the plug 6 in a reverse direction, the cylindrical spring 5 will rotate in this reverse direction together with the plug 6 to release the cylindrical spring. As a result, the ball bearings 4 are moved into the first troughs 61 due to the pressing of the notches 300 of the first retaining portion 30. The centrifugal force generated by the rotation of the plug 6 causes the ball bearings 4 to stay in the first troughs 61 when the ball bearings rotate in the reverse direction. After the rotation of the plug 6 stops, the ball bearings 4 move into the second troughs 62 to engage with the notches 300.

Figure 4:
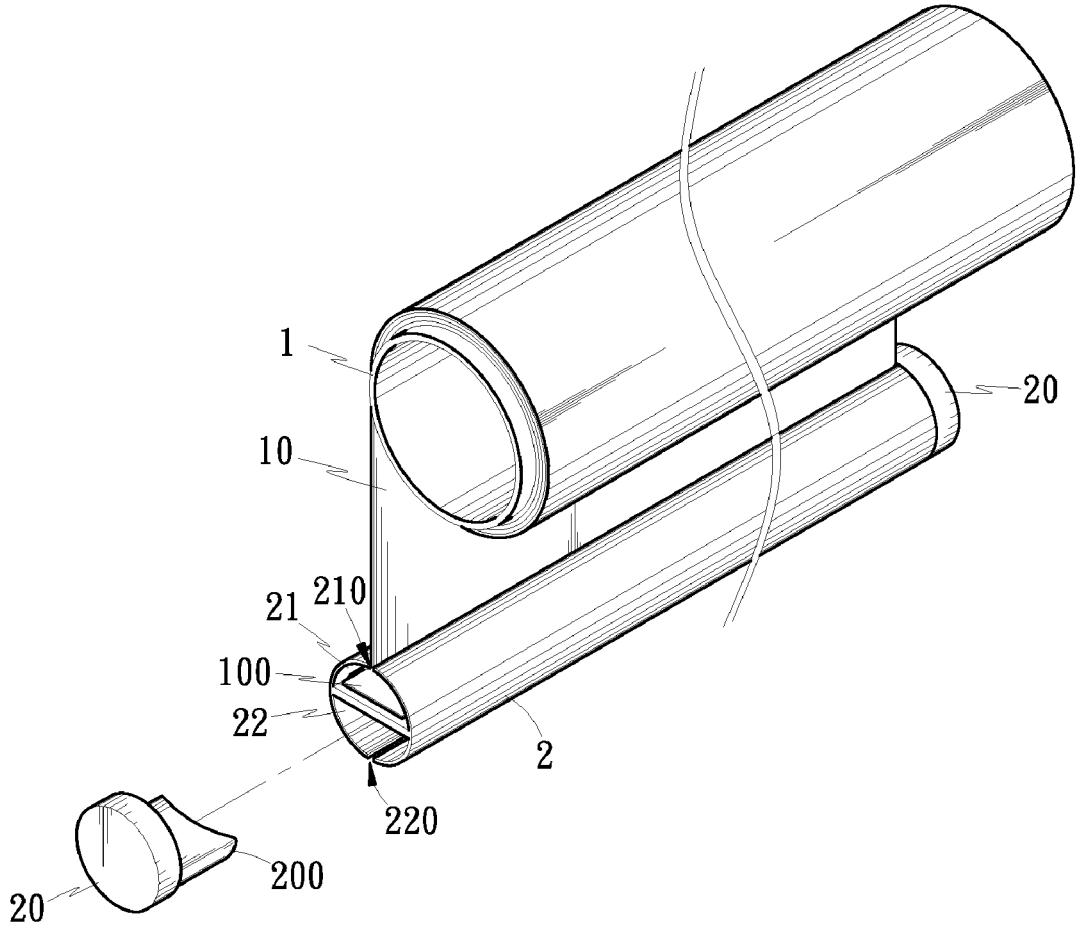
FIG. 4 is an exploded perspective view showing a second tube according to an embodiment of the present invention.
Figure 5:
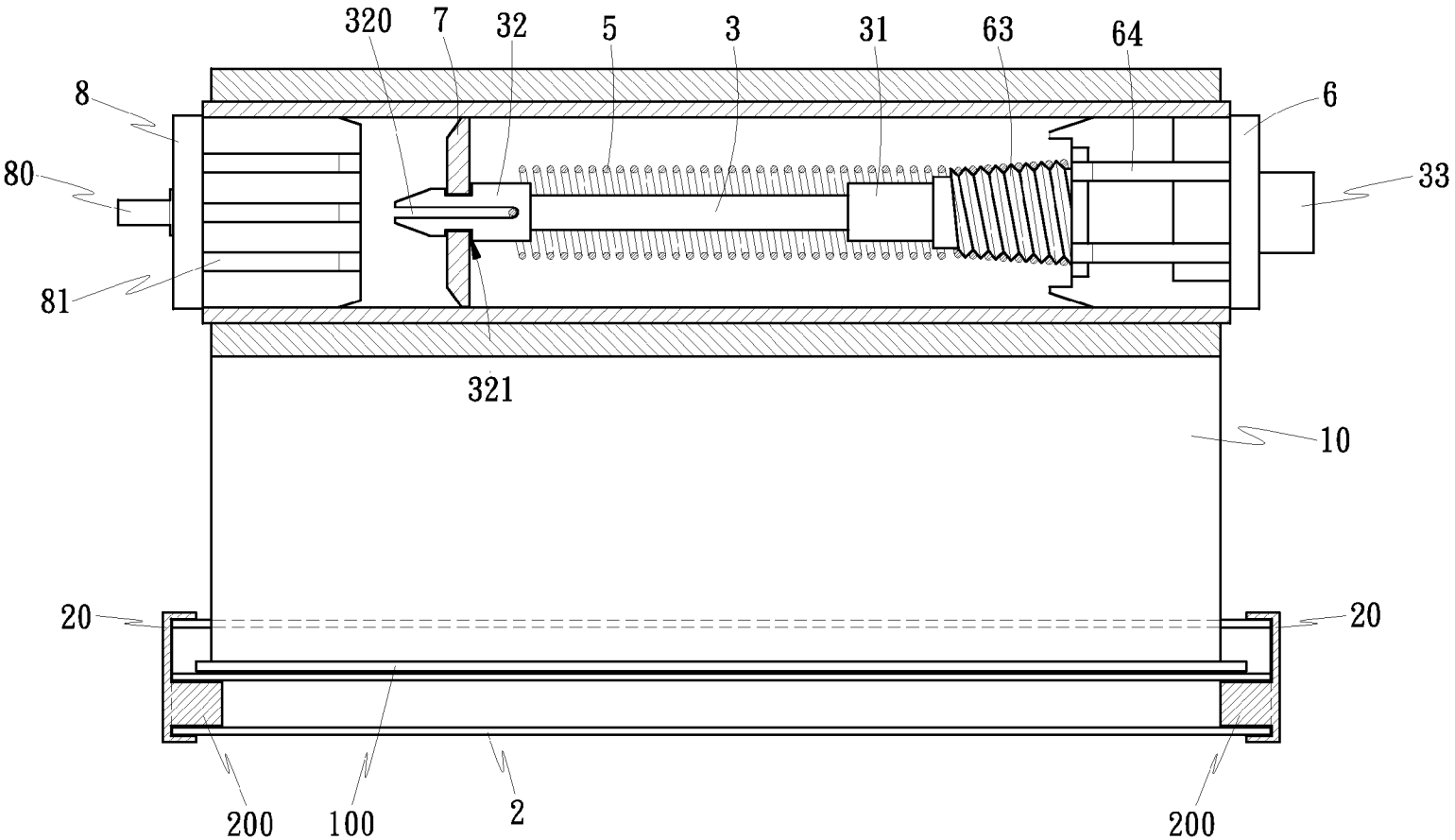
FIG. 5 is a cross-sectional view showing an automatic banner roll-up mechanism according to an embodiment of the present invention.

Please refer to FIGS. 4 and 5. The cloth 10 is wound on the outer surface of the first tube 1, and the other end of the cloth 10 is adhered to a plate 100 which is disposed in an accommodating portion 21 of the second tube 2. The cloth 10 is inserted into a groove 210 of the accommodating portion 21. The interior of the second tube 2 has two accommodating portions 21 and 22. One side of the accommodating portion 21, 22 is formed with a groove 210, 220. The groove 210, 220 of the accommodating portion 21, 22 allows the plate 100 adhered with the cloth 10 to penetrate therein. When the accommodating portion 21 is penetrated by the plate 100 and the cloth 10, the other accommodating portion 22 is inserted by a positioning post 200 of a plug 20. The plug 20 is configured as a stopper and has a semicircular positioning post 200. The plug 20 is disposed in the accommodating portion 21 or 22 to prevent the cloth 10 from sliding out of the second tube 2. The second tube 2 is used to increase the total weight of the cloth 10, thereby preventing the cloth 10 from swinging, such as due to wind. After the connecting rod 3, the cylindrical spring 5, the ball bearings 4 and the stopper 7 are disposed in the first tube 1, both ends of the first tube 1 to which the second tube 2 and the cloth 10 are connected are covered by the plugs 6 and 8. When the second tube 2 together with the cloth 10 are pulled downwards, the cylindrical spring 5 is twisted tight. After the ball bearings 4 engage with the notches 300 of the first retaining portion 30 of the connecting rod 3, the first tube 1 is locked. When the second tube 2 and the cloth 10 are further pulled downwards by a certain distance, the plug 6 is unlocked due to the reverse rotation of the cylindrical spring 5, so that the first tube 1 can rotate automatically to roll up the cloth 10 into the first tube 1.

Figure 6:
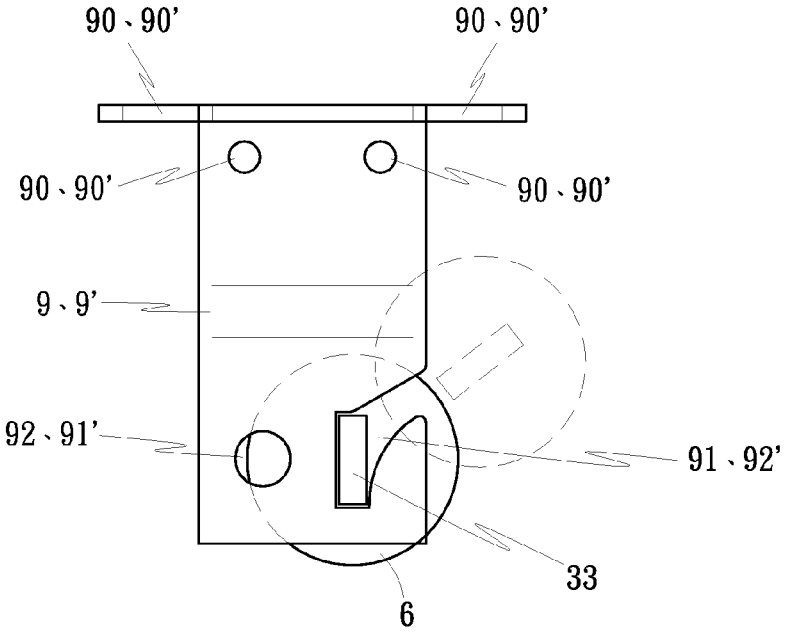
FIG. 6 is a schematic view showing that an embodiment automatic banner roll-up mechanism of the present invention is disposed between mounting supports.
Figure 7:
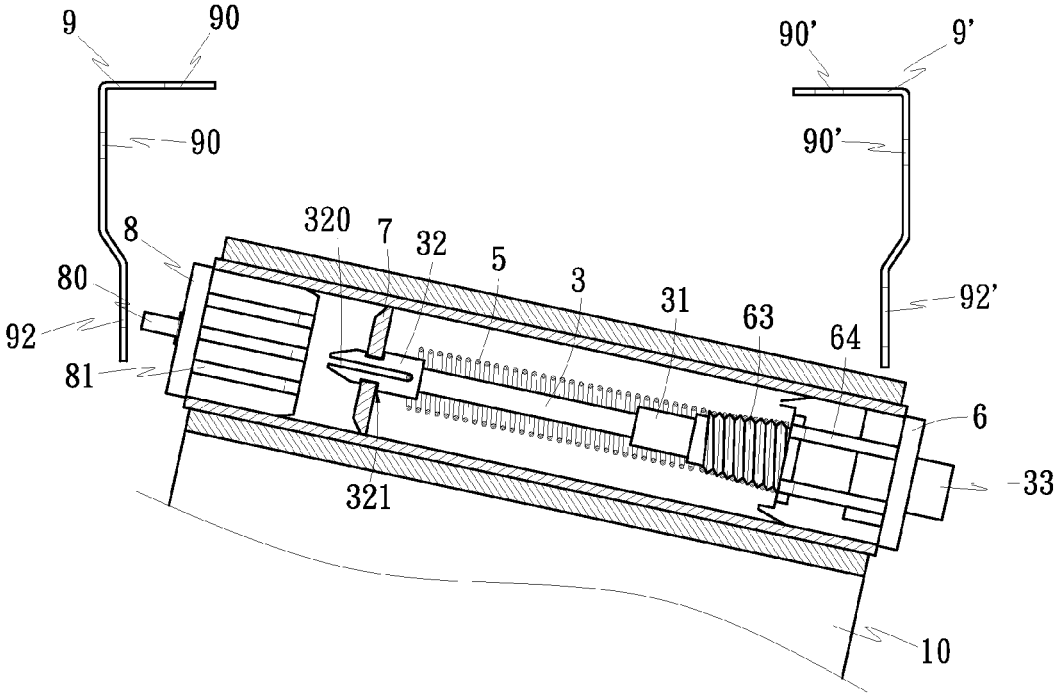
FIG. 7 is another schematic view showing that an embodiment automatic banner roll-up mechanism of the present invention is disposed between two mounting supports.
Figure 8:
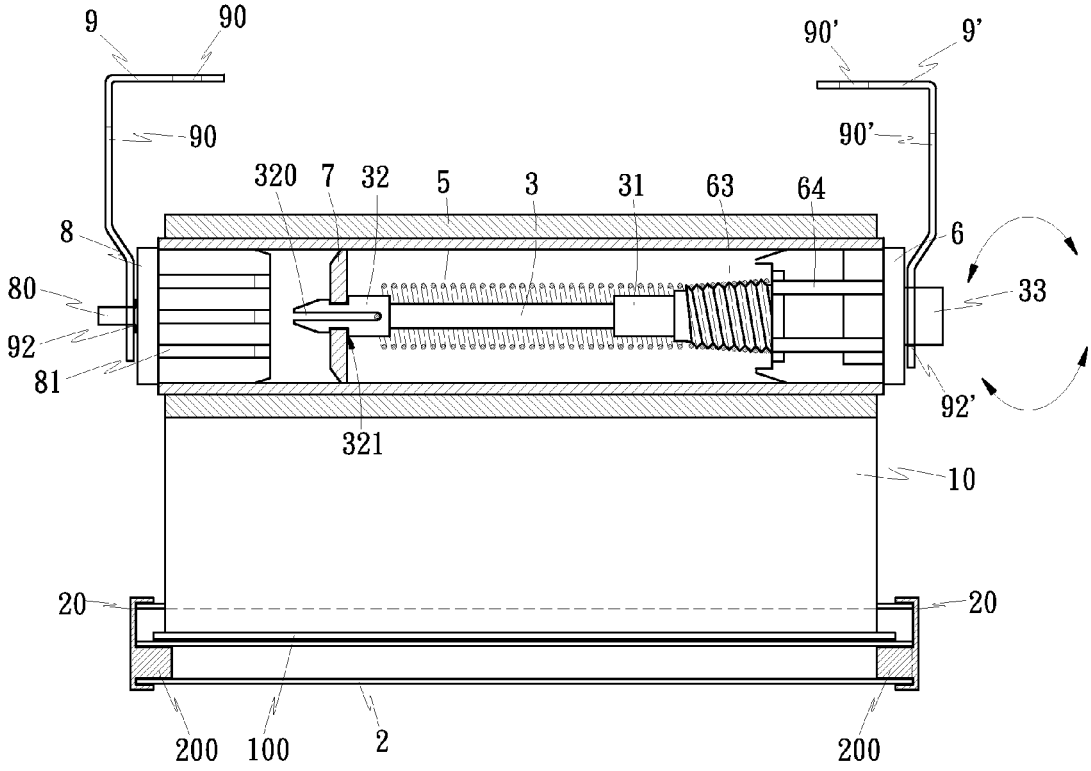
FIG. 8 is a cross-sectional view showing the operating state of an embodiment automatic banner roll-up mechanism of the present invention.

Please refer to FIGS. 6, 7 and 8. The mounting support 9, 9' is a bent plate having a plurality of through-holes 90, 90' on its top surface and its vertical surface. One end of the vertical surface of the mounting support 9, 9' is formed with a circular positioning hole 92, 91' and a rectangular positioning hole 91, 92'. The plug 8 and the plug 6 penetrated by the connecting rod 3 cover both ends of the first tube 1. When the first tube 1 is mounted on the mounting support 9, 9', the positioning post 80 of the plug 8 is inserted into the positioning hole 92 of the mounting support 9. The positioning post 33 of the connecting end 3 protruding from the other end of the first tube 1 is inserted into the positioning hole 92' of the mounting support 9'. In this way, the first tube 1 can be detachably mounted on the mounting supports 9, 9'. The rotation of the plug 6 causes the cylindrical spring 5 to be twisted tight. After rotating the plug 6 in a reverse direction for releasing the cylindrical spring 5, the cloth 10 can be rolled up automatically into the first tube 1 for storage.

What is claimed is:

1. An automatic banner roll-up mechanism, comprising a first tube, a second tube, a foldable material, a connecting rod, a plurality of ball bearings, a cylindrical spring, two plugs and a stopper, characterized in that:

the foldable material is connected between the first tube and the second tube, one end of the first tube being covered by the plug having a positioning post, the other end of the first tube covered by the other plug in which the connecting rod, the cylindrical spring, the ball bearings and the stopper are disposed, one end of the connecting rod provided with a positioning post, a first retaining portion of the connecting portion including a notch, an inner edge of one of the plugs having a plurality of first troughs and second troughs;

wherein when the plug rotates in one direction, the cylindrical spring is twisted tight and the ball bearings move into the second troughs to engage with the notch of the first retaining portion; and when the plug rotates in a reverse direction, the ball bearings move back into the first troughs, so that the cylindrical spring is released to cause the plug to rotate in the reverse direction to thereby roll up the foldable material into the first tube.

2. The automatic banner roll-up mechanism according to claim 1, wherein the mounting support has a circular positioning hole and a rectangular positioning hole.

3. The automatic banner roll-up mechanism according to claim 1, wherein the foldable material is printed or stitched with patterns.

4. The automatic banner roll-up mechanism according to claim 1, wherein the foldable material is made of paper.

5. The automatic banner roll-up mechanism according to claim 1, wherein the connecting rod includes a first retaining portion, a second retaining portion and a third retaining portion.

6. The automatic banner roll-up mechanism according to claim 4, wherein the third retaining portion has a groove.

7. The automatic banner roll-up mechanism according to claim 4, wherein the third retaining portion has a slot.

* * * * *